US008278557B2

(12) United States Patent
Widmer et al.

(10) Patent No.: US 8,278,557 B2
(45) Date of Patent: Oct. 2, 2012

(54) HIGH-VOLTAGE INSULATOR

(75) Inventors: Bruno Widmer, Jona (CH); Jean-Claude Mauroux, Hunzenschwil (CH); Martin Lakner, Gebenstorf (CH); Leopold Ritzer, Untersiggenthal (CH); Reto Weder, Habsburg (CH)

(73) Assignee: ABB Technology AG, Zürich (CH)

( * ) Notice: Subject to any disclaimer, the term of this patent is extended or adjusted under 35 U.S.C. 154(b) by 236 days.

(21) Appl. No.: 12/860,550

(22) Filed: Aug. 20, 2010

(65) Prior Publication Data

US 2011/0030994 A1 Feb. 10, 2011

Related U.S. Application Data

(63) Continuation of application No. PCT/EP2009/051840, filed on Feb. 17, 2009.

(30) Foreign Application Priority Data

Feb. 21, 2008 (EP) ..... 08151725

(51) Int. Cl.
*H01B 17/08* (2006.01)

(52) U.S. Cl. ..... 174/176; 174/179; 174/188

(58) Field of Classification Search ..... 174/179, 174/188, 176, 178, 195, 199, 15.4, 15.5, 174/15.6, 74 R, 74 A, 142
See application file for complete search history.

(56) References Cited

U.S. PATENT DOCUMENTS 1,830,870 A 11/1931 Christie
3,325,584 A * 6/1967 Herzig ..... 174/30
3,571,492 A * 3/1971 Clark et al. ..... 174/178
3,988,645 A * 10/1976 Luxa et al. ..... 361/120
4,185,161 A * 1/1980 Huang et al. ..... 174/11 R
4,267,403 A * 5/1981 Pargamin ..... 174/140 S
4,343,966 A * 8/1982 Pargamin ..... 174/140 S
4,491,687 A * 1/1985 Kaczerginski et al. ..... 174/178
5,243,132 A * 9/1993 Yarbrough ..... 174/523
6,831,232 B2 * 12/2004 Henricks et al. ..... 174/142
7,028,998 B2 * 4/2006 Daily et al. ..... 267/273
7,041,913 B2 * 5/2006 Barker et al. ..... 174/179
7,180,004 B2 * 2/2007 Barker et al. ..... 174/179

FOREIGN PATENT DOCUMENTS

CH 89 623 A 7/1921

(Continued)

OTHER PUBLICATIONS

International Search Report (PCT/ISA/210) issued on Apr. 14, 2009, for International Application No. PCT/EP2009/051840.

(Continued)

*Primary Examiner* — William Mayo, III
(74) *Attorney, Agent, or Firm* — Buchanan Ingersoll & Rooney PC

(57) ABSTRACT

A high-voltage insulator includes a metal armature, an insulating tube joined to the metal armature, which is adhesively bonded to the metal armature at an end formed as a supporting ring, and an axially symmetrical adhesive-bonding joint disposed around the axis of the insulating tube. An annular grove, which is formed in the metal armature, is disposed around the axis of the insulating tube and receives an end portion of the supporting ring. Sealing surfaces are respectively formed in the groove and in the supporting ring. The sealing surfaces are arranged and formed in such a way that, when the insulating tube and the metal armature are joined, they slide on one another, thereby forming a seal, and the supporting ring acting as a displacement body presses adhesive that has been introduced into the groove before the joining into the adhesive-bonding joint.

15 Claims, 2 Drawing Sheets

FOREIGN PATENT DOCUMENTS

| | | | |
|---|---|---|---|
| CH | 384 655 | A | 11/1964 |
| DE | 533 573 | C | 9/1931 |
| DE | 694 762 | C | 8/1940 |
| DE | 17 71 092 | U | 7/1958 |
| DE | 25 45 413 | A1 | 4/1977 |
| WO | WO 2006/053452 | A1 | 5/2006 |

OTHER PUBLICATIONS

Written Opinion (PCT/ISA/237) issued on Apr. 14, 2009, by for International Application No. PCT/EP2009/051840.

European Search Report for corresponding European Patent Application No. 08 15 1725, dated Jun. 13, 2008.

* cited by examiner

HIGH-VOLTAGE INSULATOR

RELATED APPLICATIONS

This application claims priority as a continuation application under 35 U.S.C. §120 to PCT/EP2009/051840, which was filed as an International Application on Feb. 17, 2009 designating the U.S., and which claims priority to European Application 08151725.2 filed in Europe on Feb. 21, 2008. The entire contents of these applications are hereby incorporated by reference in their entireties.

FIELD

The present disclosure relates to a high-voltage insulator, a method for producing a high-voltage insulator, and a cooling element having the high-voltage insulator.

BACKGROUND INFORMATION

A high-voltage insulator of the aforementioned type is described in DE 694 762 C. This high-voltage insulator has a metal cap and a bar insulator joined to the metal cap. Formed in the metal cap is a groove, into which an annular clamping head of the bar insulator penetrates, thereby forming the joint. A hollow space present between the cap and the clamping head is filled with a layer of a hardening binder. To introduce the binder and to ensure uniform curing of the same, the cap is provided with channels. To prevent penetration of water, these channels are closed with an elastic compound after the binder has been introduced and cured.

The production of such a high-voltage insulator is relatively complex, since the binder has to be introduced from the outside through the metal cap into the hollow space delimited by two joining parts. Moreover, when the binder is introduced through the channels, air bubbles or water can get into the hollow space and thereby reduce the dielectric strength of the insulator.

DE 533 573 C describes a high-voltage insulator used as a support for a high-voltage line, with a hollow insulating body, which is closed at one end, is cemented into a grounded mount and carries a cap supporting the high-voltage line.

CH 89 623 A describes a high-voltage insulator in which the outer surface of an insulating body has within a hollow metal cap, a bead-like thickening, beyond which the cap protrudes. A high electric field strength, and consequently partial discharge or creepage sparking, at the triple point of the metal cap, insulating body and air are thus avoided.

A further high-voltage insulator is described in WO 2006/053452 A1. The high-voltage insulator described is part of a hollow cooling element formed as a heat pipe and serving for the removal of heat from a generator discharge line. It has in a coaxial arrangement a mechanically supporting insulating tube composed of a polymer reinforced with fibers and/or filler and of coaxially held diffusion barriers as well as two hollow metal armatures, which are adhesively bonded in a vacuum-tight manner to the two ends of the insulating tube that are respectively formed as a supporting ring. An adhesive-bonding joint is provided between an adhesive-bonding surface of each of the two supporting rings and an adhesive-bonding surface of each of the two metal armatures. The adhesive-bonding joint is made to extend from the end face of each supporting ring onto the lateral surface thereof and is filled in a vacuum-tight manner with a hardened layer of adhesive.

Fastened to one of the two metal armatures is an evaporator, which is kept at the potential of a high-voltage conductor, and fastened to the other armature is a condenser, which is kept at the potential of a grounded encapsulation. The high-voltage insulator forms an insulating clearance of a cooling element which transfers heat formed by current losses in the high-voltage conductor to the encapsulation. A working medium located inside the cooling element, such as acetone or a hydrofluoric ether, serves for the heat transfer and thereby circulates as a vapor from the evaporator through the insulating tube to the condenser, in which the vapor condenses as a liquid while giving off heat. The liquid is returned to the evaporator again through the high-voltage insulator. The high-voltage insulator therefore serves not only as an insulating clearance but also as a line for the working medium. Since this line receives a chemical medium, is exposed to a permanent temperature of 80° C., for example, and must be liquid-, gas- and vacuum-tight over many years, such as 20 years, the adhesive bonds between the two ends of the insulating tube that are respectively formed as a supporting ring and the metal armatures have to meet demanding requirements.

SUMMARY

An exemplary embodiment provides a high-voltage insulator including a metal armature, and an insulating tube joined to the metal armature. The insulating tube is adhesively bonded to the metal armature at an end formed as a supporting ring. The exemplary insulator also includes an adhesive-bonding joint, which is disposed around an axis of the insulating tube, is delimited inwardly by a first adhesive-bonding surface arranged on the supporting ring, is delimited outwardly by a second adhesive-bonding surface arranged on the metal armature, and is filled with a hardened layer of adhesive. In addition, the exemplary insulator includes an annular groove, which is formed in the metal armature and disposed around the axis of the insulating tube, the annular groove being configured to receive an end portion of the supporting ring and, in a coaxial arrangement, having two mainly axially aligned flanks. An outer flank of the two mainly axially aligned flanks carries the second adhesive-bonding surface. An inner flank of the two mainly axially aligned flanks carries a first sealing surface centering the supporting ring. A second sealing surface is formed in the supporting ring. The first and second sealing surfaces are arranged and formed so that, when the insulating tube and the metal armature are joined, the first sealing surface and the second sealing surface slide on one another to form a seal, and the supporting ring acting as a displacement body presses adhesive that has been introduced into the groove before the joining into the adhesive-bonding joint.

An exemplary embodiment provides a method for producing a high-voltage insulator having a metal armature, an insulating tube, and an annular adhesive-bonding joint which is disposed around an axis of the insulating tube and delimited inwardly by a supporting ring of the insulating tube and outwardly by the metal armature. The exemplary method includes joining the insulating tube to the metal armature by introducing an end portion of the supporting ring into an annular groove formed in the metal armature and disposed around the axis of the insulating tube such that the joined parts are adhesively bonded to one another. Before the joining, the groove is filled at least partially with liquid adhesive distributed uniformly in the circumferential direction of the groove. During the joining, the liquid adhesive is pressed out of the groove into the adhesive-bonding joint by the supporting ring acting as a displacement body. During the pressing operation, excess adhesive and air are removed from the adhesive-bonding joint to outside the insulating tube via at least one venting opening led through the metal armature.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Figure 1:
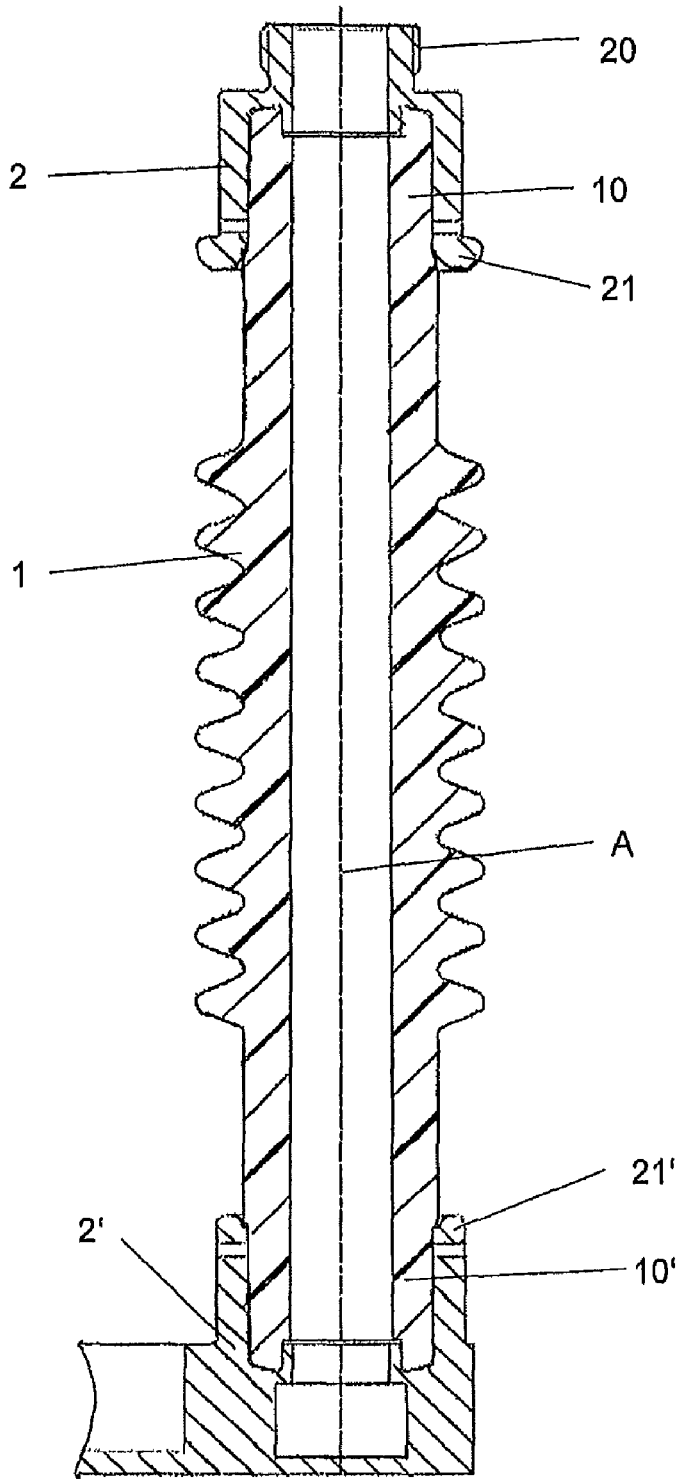
FIG. 1 shows a plan view of a section taken along a tube axis through a high-voltage insulator formed according to an exemplary embodiment of the present disclosure as a cooling element.

According to an exemplary embodiment of the present disclosure, a high-voltage insulator can include a metal armature, an insulating tube, which is adhesively bonded to the metal armature at an end formed as a supporting ring, and an axially symmetrical adhesive-bonding joint disposed around the axis of the insulating tube. The adhesive-bonding joint is delimited inwardly by an adhesive-bonding surface arranged on the supporting ring and outwardly by an adhesive-bonding surface arranged on the metal armature and is filled in a vacuum-tight manner with a hardened layer of adhesive. In the case of this high-voltage insulator, the end of the insulating tube that is remote from the supporting ring can likewise be formed as a supporting ring and be connected to a further metal armature by means of an adhesive-bonding joint.

Such an insulator may be used as an insulating clearance for passive cooling of a high-voltage device carrying high current, where high voltage should be understood as meaning in principle an operating voltage greater than 1 kV. However, the voltage range can be below 100 kV, for example, for apparatuses and installations carrying high current with nominal voltages of 10 to 50 kV, for example.

The current carrying capacity of such apparatuses and installations is thermally limited. For nominal currents in the range of 10 to 50 kA, for example, as carried for instance in high-current devices formed as generator switches, particularly active cooling elements (for example air-to-air heat exchangers with fans) or passive cooling elements with particularly good efficiency are therefore used, such as in particular heat pipes, which along with the high-voltage insulator defined at the beginning also include an evaporator and a heat exchanger as well as a working medium. Heat occurring in the high-voltage device as a result of power losses is used here for evaporating the working medium. The evaporated working medium is transported to an externally arranged heat exchanger, where it gives off the lost heat formed in the high-voltage device again by condensation.

High-voltage devices designed as generator switches are generally of a single-phase encapsulated design and have an internal conductor at high-voltage potential arranged in the encapsulation. Heat formed at the internal conductor by current losses should be dissipated to the ambient air through the encapsulation. This means that there should be an electrically insulating clearance between an evaporator at high-voltage potential and a condenser of the heat pipe kept at ground potential, a clearance which should be designed according to the required high voltage (e.g., 150 kV BIL). The evaporator and the heat exchanger (condenser) are adhesively bonded in a vacuum-tight manner to the two ends of the high-voltage insulator.

Since there is no need for moving parts, such as fans or blowers, in the case of such a high-power, passive cooling element, with this cooling element the lost heat can be removed from the encapsulation efficiently and at low cost. Furthermore, such a cooling element is maintenance-free. In addition, the high-voltage insulator performs several functions, especially that of carrying the working medium and that of separating the potentials of the evaporator and the condenser. The reliability of such a powerful passive cooling element and a high-voltage installation equipped with such a cooling element can be ensured if the insulator provides the aforementioned functions over many years. Such an insulator should therefore be maintenance-free over a long period of time, typically of 20 years. Such great long-term stability is dependent on an extremely low leakage rate. Loss of working medium and penetration of air and moisture are therefore avoided.

Exemplary embodiments of the present disclosure provide a high-voltage insulator that has a low leakage rate and has great operational reliability even after being in operation for many years under high levels of mechanical, electrical, thermal and chemical loading. In addition, exemplary embodiments of the present disclosure provide a method for producing this high-voltage insulator and a cooling element containing this insulator.

In the case of the high-voltage insulator according to exemplary embodiments of the present disclosure, an inner flank of a groove formed in a metal armature carries a first sealing surface, which centers a supporting ring of an insulating tube, and a second sealing surface is formed in the supporting ring. The two sealing surfaces are arranged and formed in such a way that, when the insulating tube and the metal armature are joined, the two sealing surfaces slide on one another, thereby forming a seal, and the supporting ring acting as a displacement body presses adhesive that has been introduced into the groove before the joining into an adhesive-bonding joint that is formed during the joining between an outer surface of the supporting ring and an outer flank of the groove.

The production of the high-voltage insulator is simplified by the suitable arrangement and formation of the metal armature and the insulating tube. The adhesive introduced into the groove before the joining is merely pressed into the adhesive-bonding joint by the force applied during the joining. Channels made to extend through the metal armature and serving for supplying adhesive and devices leading into the channels to produce compressed adhesive are therefore rendered unnecessary. Thus, a hardened layer of adhesive that is particularly homogeneous and kept free of undesired inclusions of air is achieved between the supporting ring and the metal armature by simple means and in a comparatively short time. Adhesive-bonding surfaces of the two parts which have been adhesively bonded to one another are covered 100% with hardened adhesive and the entire adhesive-bonding joint is completely filled with hardened adhesive.

Because of the sealing surfaces sliding on one another during the joining, and thereby forming a seal for the adhesive, during the joining, the adhesive is exposed to a static pressure that is adequate for completely filling with adhesive an adhesive-bonding joint made to extend far beyond the two sealing surfaces in the axial direction. Diffusion paths for air and water that are unavoidable in the hardened adhesive are thus kept long. Therefore, the high-voltage insulator according to exemplary embodiments of the present disclosure and a cooling element containing such a high-voltage insulator are distinguished by a very low leakage rate and by outstanding dielectric behavior, such as a high creepage resistance, for example. The high-voltage insulator and the cooling element according to exemplary embodiments of the present disclosure accordingly have great long-term stability. Moreover, even metal armatures which, after completion of the insulator, enclose a hollow space that is merely accessible from the interior of the insulating tube may thus be used in the production of the insulator.

If the end portion of the supporting ring is supported on the base of the groove, the good mechanical properties of the high-voltage insulator are additionally enhanced and virtually the entire adhesive is then pressed into the adhesive-bonding joint by the base of the groove during production, whereby a good adhesively bonded connection is achieved with little adhesive.

If the adhesive-bonding joint extends into the base of the groove and is connected at the end remote from the base of the groove to at least one venting opening that is led through the metal armature to the outside, excess adhesive and air can escape from the entire adhesive-bonding joint during the adhesive bonding of the insulating tube and the metal armature. This effectively prevents adhesive from getting into the dielectrically particularly critical interfacial region between the metal armature, the insulating tube and the air (triple point), whereby an adhesively bonded connection between the insulating tube and the metal armature of a particularly high quality in mechanical, vacuum-related and dielectric terms is ensured.

If the outer groove flank extends further in the axial direction than the inner groove flank and if a guiding surface centering the supporting ring is formed on the end of the outer groove flank that is remote from the base of the groove, this guiding surface and the centering sealing surface formed in the inner groove flank may have a small extent in the axial direction in a way that is advantageous in production-related terms, for example. Reliable centering of the insulating tube via two guiding surfaces kept at a relatively great distance in the axial direction in the metal armature is then indeed ensured.

Unavoidable mechanical stresses in the hardened layer of adhesive are reduced if the cross section of the adhesive-bonding joint decreases from the base of the groove to the venting opening. Such a cross section is achieved in a way that is advantageous in production-related terms by conical formation of the adhesive-bonding surface arranged on the insulating tube and cylindrical formation of the adhesive-bonding surface arranged on the metal armature.

If at least one rib that is made to extend mainly in the circumferential direction is formed in at least one of the aforementioned two adhesive-bonding surfaces, the diffusion path for moisture and air penetrating into the adhesive-bonding joint from the outside is then extended, and so the undesired penetration of moisture and air into the interior of the high-voltage insulator is largely avoided. At the same time, the creation of a series of small air bubbles in the axial direction at the adhesively bonded location is thus also counteracted, and so a vacuum-tight adhesively bonded location is achieved.

In the case of a method suitable for producing this or another high-voltage insulator with a metal armature, an insulating tube and an annular adhesive-bonding joint, which is disposed around the axis of the insulating tube and delimited inwardly by a supporting ring of the insulating tube and outwardly by the metal armature, before the joining, the groove is filled at least partially with liquid adhesive distributed uniformly in the circumferential direction in the groove. During the joining, the liquid adhesive is pressed out of the groove into the adhesive-bonding joint by the supporting ring acting as a displacement body. During the pressing operation, excess adhesive and air are removed from the adhesive-bonding joint to the outside by way of at least one venting opening led through the metal armature.

The liquid adhesive is therefore introduced into the adhesive-bonding joint without any air bubbles and in a well-distributed manner, whereby a vacuum-tight adhesively bonded connection is achieved in a way that is reliable and can be reproduced well. Therefore, vacuum-tight high-voltage insulators of a low leakage rate and a long service life can be produced by the method, with scarcely any rejects.

Further features and further advantageous effects of the present disclosure are evident from the following description of exemplary embodiments of the present disclosure.

In the drawings, the same reference numerals indicate identical parts or identically functioning parts. A tubular high-voltage insulator represented in FIG. 1 includes an insulating tube 1 which is made to extend along an axis A. The insulating tube 1 is provided with a shielding on its outer side, where the shielding extends along the creepage path. According to an exemplary embodiment, the insulating tube 1 can be produced from a polymeric composite material, for example, on the basis of a thermoset, such as an epoxy, for example, and a filler, such as silica flour or glass fibers, for example. Alternatively, the insulating tube 1 may also be produced from a ceramic, such as porcelain, for example. The two ends of the insulating tube 1 are respectively formed as a supporting ring 10 and 10' and are both adhesively bonded in a vacuum-tight manner to a metal armature 2 and 2', respectively. It can be seen that the upper armature 2 is of an annular form and is provided with an external thread 20 and a field electrode 21, which is disposed around the insulating tube 1 and which, during operation of the insulator, controls the electric field induced by the applied high voltage in the triple point that is formed by the metal armature 2, the insulating tube 1 and the surrounding air. A metal vessel may be screwed onto the external thread 20 in a vacuum-tight manner. The interior of this vessel is then connected in a vacuum-tight manner to the interior of the insulating tube 1. The lower armature 2' includes a field electrode 21' disposed around the insulating tube 1 and, as can be seen, is already formed as a vessel. Therefore, the armature 2' has a hollow space communicating with the interior of the tube 1.

An insulator closed in this way can be filled with a working medium, such as acetone or hydrofluoric ether, for example. During fitting into a high-voltage installation, the armature 2' can then be fastened in a thermally conducting manner to a current conductor that is loaded with nominal currents, while the metal vessel held on the armature 2 may be connected to a metal encapsulation serving for the removal of heat and at ground potential. The high-voltage insulator can then constitute a cooling element which extracts heat from the current conductor by an evaporating liquid working medium in the metal armature 2' serving as an evaporator, and heat is thereby dissipated to the outside (e.g., outside the insulator) by condensation of the evaporated working medium on the cooled metal vessel serving as a condenser.

Figure 3:
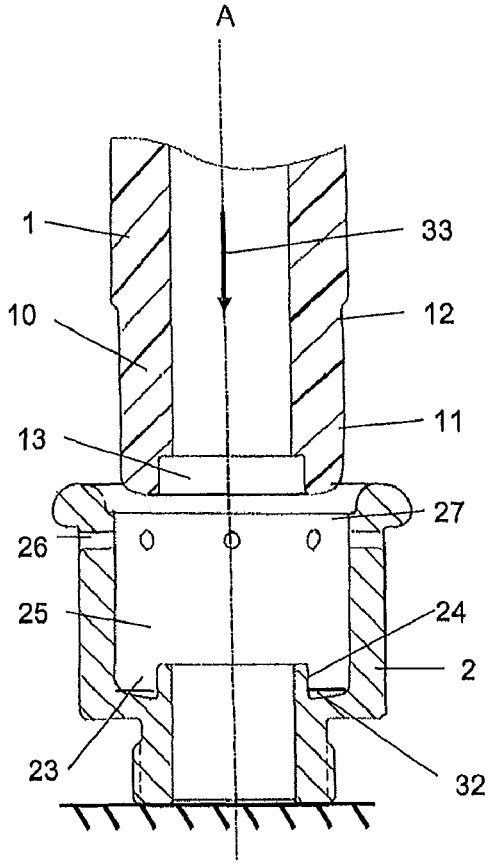
FIG. 3 shows the metal armature according to FIG. 2, which is being joined to an insulating tube of the insulator to be produced after the introduction of the adhesive, according to an exemplary embodiment of the present disclosure.

According to an exemplary embodiment, the two supporting rings 10, 10' can be identically formed. As is shown in FIG. 3 in the case of the supporting ring 10, the supporting rings 10, 10' respectively include, on their outer side, a conical adhesive-bonding surface 11 that adjoins the end of the insulating tube 1, and a cylindrical guiding surface 12 that adjoins the adhesive-bonding surface 11. As can be seen, the supporting rings 10, 10' respectively include, on the inner side, a cylindrical surface 13 that adjoins the end of the tube and performs a sealing and guiding function. According to an exemplary embodiment, the surfaces 11, 12 and 13 can be respectively formed in the supporting rings 10, 10' by machining, such as turning and/or grinding, for example.

Figure 2:
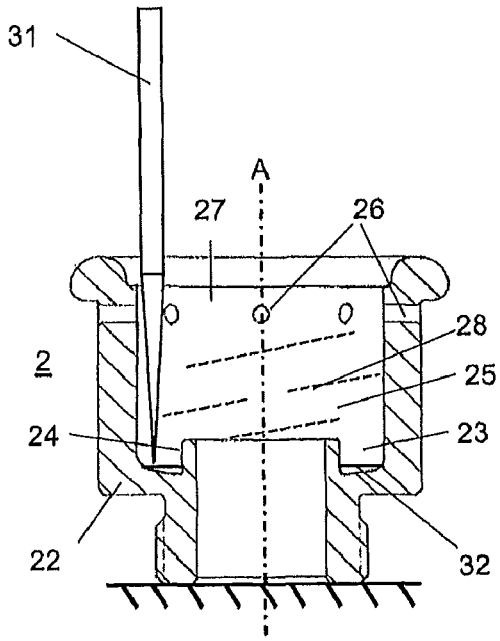
FIG. 2 shows in an enlarged representation a metal armature of the high-voltage insulator according to FIG. 1, into which liquid adhesive is being introduced during the production of the insulator, according to an exemplary embodiment of the present disclosure.
Figure 4:
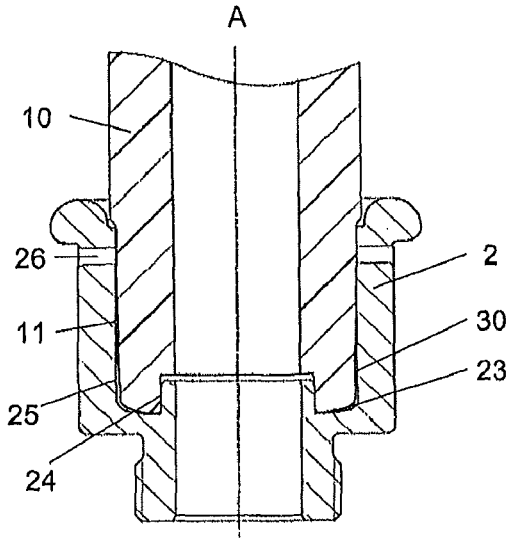
FIG. 4 shows the metal armature according to FIG. 3, which after joining to a hardened layer of adhesive is fixed on an end of the insulating tube formed as a supporting ring, according to an exemplary embodiment of the present disclosure.

The parts of the metal armatures 2, 2' that are adhesively bonded to the supporting rings 10, 10' can also be identically formed. As is shown in FIGS. 2 to 4 in the case of the metal armature 2, they each include a shoulder 22, in which there is formed an annular groove 23 disposed around the axis of the insulating tube 1. This groove 23 has in coaxial arrangement two flanks aligned mainly along the axis A. The inner flank carries a sealing surface 24 centering around the supporting ring 10. The outer flank carries a cylindrical adhesive-bonding surface 25 that is made to extend into the base of the groove 23. Above the adhesive-bonding surface 25 are a number of venting openings 26, which are uniformly distributed in the circumferential direction and lead mainly radially outward through the metal armature 2. At the end of the outer flank that is remote from the base of the groove, a cylindrical guiding surface 27 that centers the supporting ring 10 is formed in the metal armature 2 above the venting openings 26.

FIG. 4 illustrates that the adhesive-bonding surfaces 11 and 25 delimit an adhesive-bonding joint 30, which is made to extend into the base of the groove 23, is disposed annularly around the axis A and is filled in a vacuum-tight manner with a hardened layer of adhesive. Since the adhesive-bonding surface 11 widens conically upward from the base of the groove 23 and since the adhesive-bonding surface 25 is cylindrical, the cross section of the adhesive-bonding joint 30 decreases from the base of the groove 23 toward the venting openings 26. At least one rib 28 that is made to extend mainly in the circumferential direction (indicated in FIG. 2 by dashed lines) may be formed in at least one of the adhesive-bonding surfaces 11, 25.

To produce the high-voltage insulator, the metal armature 2 is clamped in such a way that the annular groove 23 is horizontally aligned and accessible from above (in the direction as represented in FIG. 2). With the aid of a static mixer 31 that is schematically represented in FIG. 2, a liquid adhesive 32, such as an epoxy-based two-component adhesive, for example, is introduced into the annular groove 23 and distributed uniformly over the entire circumference of the groove. In the case of an insulating tube used for high voltages from 10 to 30 kV, for example, with a diameter of typically 40 to 60 mm, for example, 2 to 3 ml of adhesive, for example, are introduced into the groove.

As can be seen from FIG. 3, the insulating tube 1 is then pushed into the metal armature 2 from above, in the direction of an arrow 33, and joined to the metal armature 2, thereby forming the adhesive-bonding joint. During the joining, the free end portion of the supporting ring 10 penetrates into the groove 23. The two guiding surfaces 12 and 13 of the supporting ring 10 thereby slide on the corresponding guiding surfaces 24 and 27, respectively, of the metal armature 2 and ensure that the insulating tube 1 is centered. As soon as the free end portion of the supporting ring 10 penetrates into the adhesive 32, the supporting ring 10 acts as a displacement body and presses the adhesive upward. Since the guiding surfaces 13 and 24 are formed as sealing surfaces and form a seal for the adhesive 32 as they slide on one another, the displaced adhesive 32 is pressed by the base of the groove along the adhesive-bonding surfaces 11 and 25 into the adhesive-bonding joint 30. Excess adhesive and air escape to the outside through the venting openings 26 connected to the adhesive-bonding joint 30.

As soon as the supporting ring hits the metal armature 2, for example with its free end, the joining and displacing process is ended and the adhesive-bonding joint 30 is then completely filled with adhesive, as illustrated in FIG. 4. After curing at an elevated temperature of, for example, 60 to 90° C., an adhesively bonded location is achieved, distinguished by a high mechanical shear strength of 20 $N/mm^2$, for example, and a good vacuum tightness with a leakage rate of less than $10^{-9}$ mbar l/s, for example. Since the excess adhesive during the joining and displacing process is led to the outside in the venting openings 26 through the metal armature 2, the penetration of adhesive into an air-filled annular space that is arranged above the openings 26 and is delimited by the free end of the metal armature 2 and the insulating tube 1 can be avoided. By suitable measures, such as for instance a defined air gap made to extend radially and disposed in the circumferential direction around the axis A between the insulating tube 1 and the free end of the metal armature 2 as well as by formation of the free end of the metal armature 2 as a field-controlling bead, the electric field in the dielectrically critical annular space can be controlled, and undesired partial electrical discharges can be effectively avoided.

A good distribution of the adhesive 32 in the adhesive-bonding joint 30, and consequently a void-free, hardened layer of adhesive 32, is achieved by the adhesive 32 being introduced particularly uniformly in the groove 23 before the joining, for instance by turning the armature 2 and the mixer 30 with respect to one another. According to an exemplary embodiment, the cross section of the adhesive-bonding joint decreases in the direction of flow of the liquid adhesive 32, which enables the liquid adhesive to pass from the base of the groove into the adhesive-bonding joint 30 very uniformly and without any air bubbles. Therefore, a void-free hardened layer of adhesive 32 is achieved at the adhesively bonded location. In addition, the thickness of this layer of adhesive 32 increases toward the end face of the supporting ring 10. Undesired voltage increases at the end of the insulating tube 1 are thus greatly reduced.

The at least one rib 28 has the effect of extending the diffusion path for moisture and air penetrating into the adhesive-bonding joint 30 from the outside and significantly reducing the undesired penetration of moisture and air into the interior of the high-voltage insulator. At the same time, this arrangement avoids the creation of a series of small air bubbles in the axial direction at the adhesively bonded location, whereby the quality and impermeability of the adhesively bonded location are additionally improved.

In a corresponding way, the insulating tube 1 may also be adhesively bonded to the metal armature 2'. This adhesive bond achieves a vacuum-tight hollow space that is merely accessible from the outside by way of the supporting ring 10 or the metal armature 2.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF DESIGNATIONS

A axis
1 insulating tube
2, 2' metal armatures
10, 10' supporting rings
11 adhesive-bonding surface
12 guiding surface
13 sealing surface
20 external thread
21, 21' field electrodes
22 shoulder
23 groove
24 sealing surface
25 adhesive-bonding surface
26 venting openings
27 guiding surface
28 rib
30 adhesive-bonding joint
31 static mixer
32 adhesive
33 arrow

What is claimed is:

1. A high-voltage insulator comprising:

a metal armature;

an insulating tube joined to the metal armature, the insulating tube being adhesively bonded to the metal armature at an end formed as a supporting ring;

an adhesive-bonding joint, which is disposed around an axis of the insulating tube, is delimited inwardly by a first adhesive-bonding surface arranged on the supporting ring, is delimited outwardly by a second adhesive-bonding surface arranged on the metal armature, and is filled with a hardened layer of adhesive; and an annular groove, which is formed in the metal armature and disposed around the axis of the insulating tube, the annular groove being configured to receive an end portion of the supporting ring and, in a coaxial arrangement, having two mainly axially aligned flanks, of which an outer flank of the two mainly axially aligned flanks carries the second adhesive-bonding surface, wherein an inner flank of the two mainly axially aligned flanks carries a first sealing surface centering the supporting ring, a second sealing surface is formed in the supporting ring, and the first and second sealing surfaces are arranged and formed so that, when the insulating tube and the metal armature are joined, the first sealing surface and the second sealing surface slide on one another to form a seal, and the supporting ring acting as a displacement body presses adhesive that has been introduced into the groove before the joining into the adhesive-bonding joint.

2. The insulator as claimed in claim 1, wherein the end portion of the supporting ring is supported on the base of the groove.

3. The insulator as claimed in claim 2, wherein the adhesive-bonding joint extends into the base of the groove and is connected at an end remote from the base of the groove to at least one venting opening that is led through the metal armature to outside of the insulator.

4. The insulator as claimed in claim 3, wherein the outer groove flank extends further in the axial direction than the inner groove flank, and a guiding surface centering the supporting ring is formed on the end of the outer groove flank that is remote from the base of the groove.

5. The insulator as claimed in claim 1, wherein the adhesive-bonding joint extends into the base of the groove and is connected at an end remote from the base of the groove to at least one venting opening that is led through the metal armature to outside of the insulator.

6. The insulator as claimed in claim 5, wherein the outer groove flank extends further in the axial direction than the inner groove flank, and a guiding surface centering the supporting ring is formed on the end of the outer groove flank that is remote from the base of the groove.

7. The insulator as claimed in claim 5, wherein a cross section of the adhesive-bonding joint decreases from the base of the groove to the at least one venting opening.

8. The insulator as claimed in claim 7, wherein the first adhesive-bonding surface is of a conical formation, and the second adhesive-bonding surface is of a cylindrical formation.

9. The insulator as claimed in claim 8, comprising:

at least one rib that is extends mainly in the circumferential direction is formed in at least one of the first adhesive-bonding surface and the second adhesive-bonding surface.

10. The insulator as claimed in claim 5, wherein the metal armature encloses a hollow space that is only open toward the insulating tube.

11. A cooling element comprising a high-voltage insulator as claimed in claim 10, wherein the metal armature is formed as an evaporator.

12. The insulator as claimed in claim 1, comprising:

at least one rib that is extends mainly in the circumferential direction is formed in at least one of the first adhesive-bonding surface and the second adhesive-bonding surface.

13. The insulator as claimed in claim 1, wherein the metal armature encloses a hollow space that is only open toward the insulating tube.

14. A cooling element comprising a high-voltage insulator as claimed in claim 13, wherein the metal armature is formed as an evaporator.

15. A method for producing a high-voltage insulator having a metal armature, an insulating tube, and an annular adhesive-bonding joint which is disposed around an axis of the insulating tube and delimited inwardly by a supporting ring of the insulating tube and outwardly by the metal armature, the method comprising:

joining the insulating tube to the metal armature by introducing an end portion of the supporting ring into an annular groove formed in the metal armature and disposed around the axis of the insulating tube such that the joined parts are adhesively bonded to one another, wherein, before the joining, the groove is filled at least partially with liquid adhesive distributed uniformly in the circumferential direction of the groove, and during the joining the liquid adhesive is pressed out of the groove into the adhesive-bonding joint by the supporting ring acting as a displacement body, and during the pressing operation, excess adhesive and air are removed from the adhesive-bonding joint to outside the insulating tube via at least one venting opening led through the metal armature.

* * * * *